US006104264A

United States Patent [19]

Ishikawa et al.

[11] Patent Number: 6,104,264

[45] Date of Patent: Aug. 15, 2000

[54] DIELECTRIC WAVEGUIDE OF A LAMINATED STRUCTURE

[75] Inventors: Yohei Ishikawa; Toru Tanizaki, both of Kyoto; Hiroshi Nishida, Kawanishi; Atsushi Saitoh, Muko, all of Japan

[73] Assignee: Murata Manufacturing Co., Ltd., Japan

[21] Appl. No.: 09/019,133

[22] Filed: Feb. 5, 1998

[30] Foreign Application Priority Data

Feb. 6, 1997 [JP] Japan ..... 9-023879

[51] Int. Cl.[7] ..... H01P 3/18

[52] U.S. Cl. ..... 333/239; 333/248

[58] Field of Search ..... 333/239, 248

[56] References Cited

U.S. PATENT DOCUMENTS

| | | | |
|---|---|---|---|
| 3,771,077 | 11/1973 | Tischer | 333/95 |
| 4,463,330 | 7/1984 | Yoneyama | 333/239 |
| 4,556,855 | 12/1985 | Chiang et aL. | 333/113 |
| 5,382,931 | 1/1995 | Piloto et al. | 333/208 |
| 5,757,331 | 5/1998 | Yoneyama et al. | 333/239 X |
| 5,770,981 | 6/1998 | Koizumi et al. | 333/26 |
| 5,770,989 | 6/1998 | Ishikawa et al. | 333/248 |

FOREIGN PATENT DOCUMENTS

| | | |
|---|---|---|
| 2528633 | 12/1983 | France . |
| 2275826 | 9/1994 | United Kingdom . |

OTHER PUBLICATIONS

"Milimeter–Wave Integrated Circuits Using Nonradiative Dielectric Waveguide", Tsukasa Yoneyama, Electronics & Communications in Japan, Part II–Electronics, vol. 74, No. 2, Feb. 1, 1991, pp. 20–28.

"Analysis of Multilayer Inset Dielectric Guides Containing Magnetised Ferrites" Z. Fan et al., IEE Proceedings: Microwaves, Antennas and Propagation, vol. 143, No. 5, Oct. 1996, pp. 390–396.

European Search Report dated Sep. 7, 1998.

*Primary Examiner*—Benny Lee

*Attorney, Agent, or Firm*—Ostrolenk, Faber, Gerb & Soffen, LLP

[57] ABSTRACT

A dielectric waveguide has a plurality of dielectric ceramic sheets each having a high-dielectric-constant portion and a low-dielectric-constant portion. The dielectric ceramic sheets are laminated and baked and electrode films are formed on the outer surfaces thereof. Thus, a dielectric waveguide is obtained in which the high-dielectric-constant portion serves as a propagating area and the low-dielectric-constant portion serves as a non-propagating area.

14 Claims, 9 Drawing Sheets

DIELECTRIC WAVEGUIDE OF A LAMINATED STRUCTURE

BACKGROUND OF THE INVENTION

1. Field of the Invention

The present invention relates to a dielectric waveguide, particularly a dielectric waveguide for use in a transmission line or an integrated circuit for the millimeter-wave band or the micro-wave band.

2. Description of the Related Art

In a known dielectric waveguide, an electromagnetic wave is transferred along a dielectric strip provided between two parallel electrically conductive planes. Particularly when the distance between the two electrically conductive planes is set to half the wavelength or less to provide a non-propagating area, the known dielectric waveguide is a non-radiative dielectric waveguide ("NRD guide"), which does not radiate an electromagnetic wave from the dielectric strip. An NRD guide has been used as a transmission line having a low transmission loss or as an integrated dielectric waveguide apparatus.

FIGS. 15A and 15B are cross-sectional views showing two examples of conventional NRD guide configurations. In FIG. 15A, two metallic electrically conductive plates 12 form two parallel electrically conductive planes, and a dielectric strip 11 is disposed therebetween. FIG. 15B shows two dielectric plates 11' made from synthetic resin or dielectric ceramic and having dielectric strips 11 and electrode films 5 on the respective main surfaces of the dielectric plates 11'. The two dielectric plates 11' are disposed such that the dielectric strips 11 oppose each other. As described above, the NRD guides are formed with the dielectric strips serving as propagating areas and the areas on both sides thereof serving as non-propagating areas.

With the dielectric waveguide having the structure shown in FIG. 15A, the electrically conductive plates 12 and the dielectric strip 11 need to be manufactured separately, and it is difficult to position and secure the dielectric strip 11 against the electrically conductive plates 12. With the dielectric waveguide having the structure shown in FIG. 15B, to use the dielectric strips 11 as the propagating areas and the areas on both sides thereof as non-propagating areas, the side portions (flanges) of the dielectric plates 11' disposed in the non-propagating areas need to be thin. This brings about difficulty in manufacturing the dielectric waveguide and a strength problem may arise.

SUMMARY OF THE INVENTION

The present invention provides a dielectric waveguide which is improved with respect to positioning and securing its dielectric strips, with respect to its manufacturing process, and with respect to its strength.

According to one aspect of the present invention, a dielectric waveguide comprises a dielectric strip disposed between two substantially parallel electrically conductive planes, wherein a plurality of dielectric ceramic sheets are laminated and baked, each dielectric ceramic sheet having a first area having a high effective dielectric constant and a second area having a lower effective dielectric constant than the first area, and electrode films are formed on the outer surfaces thereof, whereby the first area serves as the dielectric strip, and the electrode films serve as the electrically conductive planes.

With this structure, since the electrically conductive planes and the dielectric strip are laminated and baked together, unlike the dielectric waveguide shown in FIG. 15A, it is unnecessary to manufacture the electrically conductive plates and the dielectric strip separately, which eliminates the problem of positioning and securing them.

In addition, the second area having a lower effective dielectric constant can be made of portions of a plurality of laminated dielectric sheets having a lower effective dielectric constant, rather than of air. Thus, a dielectric ceramic layer having a lower effective dielectric constant can be provided to serve as the non-propagating area, rather than air, unlike the dielectric waveguide shown in FIG. 15B. Thus, the problems in manufacturing and strength caused by having a thin non-propagating area are also eliminated.

According to another aspect of the present invention, a dielectric waveguide comprises a dielectric strip which is made up of a plurality of dielectric strip sections separated by surfaces which extend parallel to two electrically conductive planes. Two dielectric plates are each made of a plurality of laminated and baked dielectric ceramic sheets, each dielectric ceramic sheet having a first area with a high effective dielectric constant and a second area with a lower effective dielectric constant than the first area. Each dielectric plate has an electrode film on one main surface. The two dielectric plates are disposed such that the surfaces on which the electrode films are formed are placed on the outside and the respective first areas oppose each other, so that the first areas serve as one or more dielectric strips, and the electrode films serve as the electrically conductive planes. The second areas may serve as non-propagating areas.

With this structure, a substrate having a plane circuit can be disposed between the two dielectric plates, each dielectric plate having a respective electrode film on one main surface opposite to the substrate, whereby a plane-circuit coupling type dielectric waveguide can easily be formed.

In the electric waveguide, the second area having a lower effective dielectric constant can be formed by providing dielectric ceramic sheets having openings made in advance, and laminating the openings. In this case, a laminated structure of dielectric ceramic having the first area with a high effective dielectric constant and the second area with a low effective dielectric constant is easily formed. The openings may define the entire second area. That is, the second area may be made of an air layer.

Even if the openings define the entire second area, the second area may be filled with a dielectric having a lower dielectric constant than the first area. In this case, problems in manufacturing and strength caused by having a thin non-propagating area can be eliminated.

Or, the second area may be made of ceramic sheets with a number of minute openings (holes), which also eliminates the problems in manufacturing and strength caused by having a thin non-propagating area.

The dielectric waveguide may also be formed by laminating a plurality of dielectric ceramic sheets in which openings are made in advance, and filling the portion where the openings are laminated with a dielectric having a higher dielectric constant than the dielectric ceramic sheets to form the first area. In this case, a laminated structure of dielectric ceramic having the first area with a high effective dielectric constant and the second area with a low effective dielectric constant is easily formed. Since the non-propagating areas are not thin, problems in strength and manufacturing are avoided. Also in this case, the openings may define the entire the first area.

A dielectric waveguide may also be configured by providing the first area with a number of minute openings (holes) and filling each opening with a dielectric having a high dielectric constant.

Other features and advantages of the invention will be seen in the following detailed description of embodiments of the invention, with reference to the drawings, in which like reference labels denote like elements and parts.

DETAILED DESCRIPTION OF EMBODIMENTS OF THE INVENTION

Figure 1:
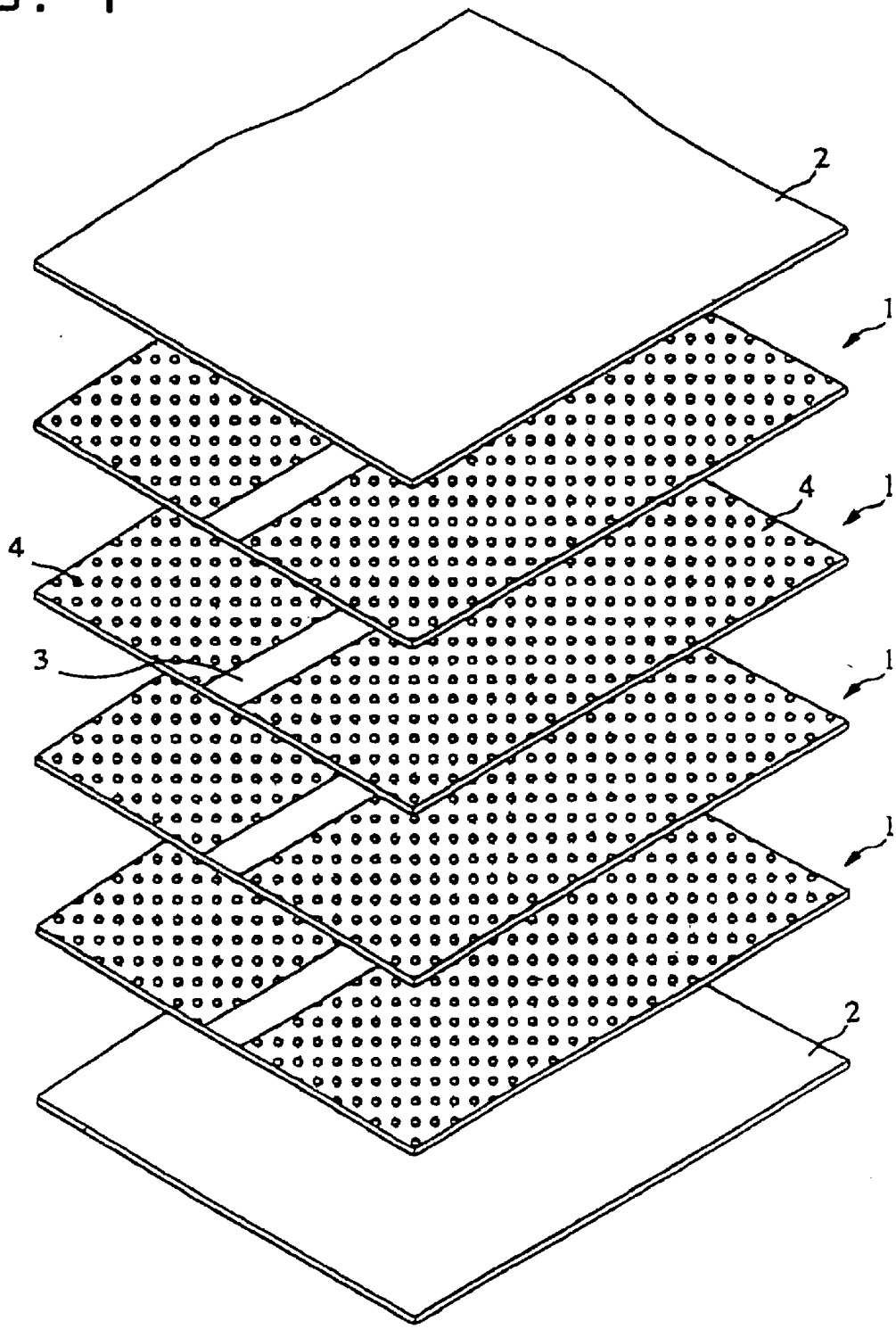
FIG. 1 is an exploded perspective view of a dielectric waveguide according to a first embodiment of the invention.
Figure 2:
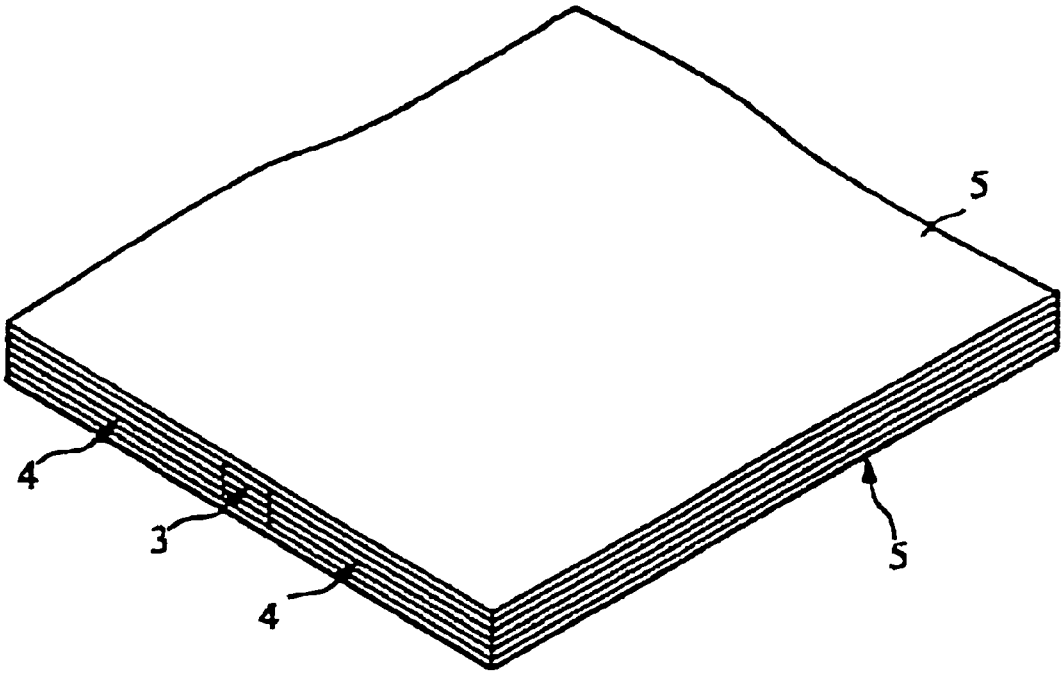
FIG. 2 is a perspective view of the dielectric waveguide of FIG. 1.

FIG. 1 and FIG. 2 show the structure of a dielectric waveguide according to a first embodiment of the present invention.

FIG. 1 is an exploded perspective view showing a plurality of separate substantially planar dielectric ceramic sheets 1,2 constituting a dielectric waveguide. The dielectric ceramic sheets 2 serving as the outermost layers have a uniform dielectric constant whereas the dielectric ceramic sheets 1 include high-dielectric-constant portions 3 and low-dielectric-constant portions 4. The low-dielectric-constant portions 4 are made by punching a number of minute holes in the dielectric ceramic sheets 1. In other words, the effective dielectric constant of the high-dielectric-constant portions 3 is the same as that of the original dielectric ceramic sheet. The effective dielectric constant of the low-dielectric-constant portions 4 is lower than that of the high-electric-constant portions 3.

Alternatively, the difference between the high and low dielectric constants may be formed by joining two kinds of dielectric materials to form each sheet 1.

FIG. 2 shows the condition after the dielectric ceramic sheets 1 and 2 illustrated in FIG. 1 have been laminated in a green sheet state (unbaked state) and baked to form a unit, and electrode films 5 are formed on the upper and lower surfaces thereof. The electrode films 5 are formed by Ag electrode printing or Cu plating. The distance between the electrode films 5 is half, or less, of the guide wavelength of the dielectric waveguide determined by the effective dielectric constant of the low-dielectric-constant portions 4, so that the portions 4 become non-propagating areas; and is more than half of the guide wavelength of the dielectric waveguide determined by the effective dielectric constant of the high-dielectric-constant portions 3 so that the portions 3 become propagating areas. Under these conditions, the electrode films 5 form two parallel electrically conductive planes, the high-dielectric-constant portions 3 therebetween serve as a dielectric strip which works as a propagating area for transmitting an electromagnetic wave having a polarization parallel to the electrode films 5, and the low-dielectric-constant portions 4 at both sides thereof work as non-propagating areas for blocking an electromagnetic wave having a polarization parallel to the electrode films 5.

As shown in FIG. 1, since the outermost dielectric ceramic sheets are homogeneous (having no minute openings), electrode films can easily be formed on the outside surfaces thereof.

The structure of a dielectric waveguide according to a second embodiment will be described below by referring to FIG. 3 to FIG. 6.

Figure 3:
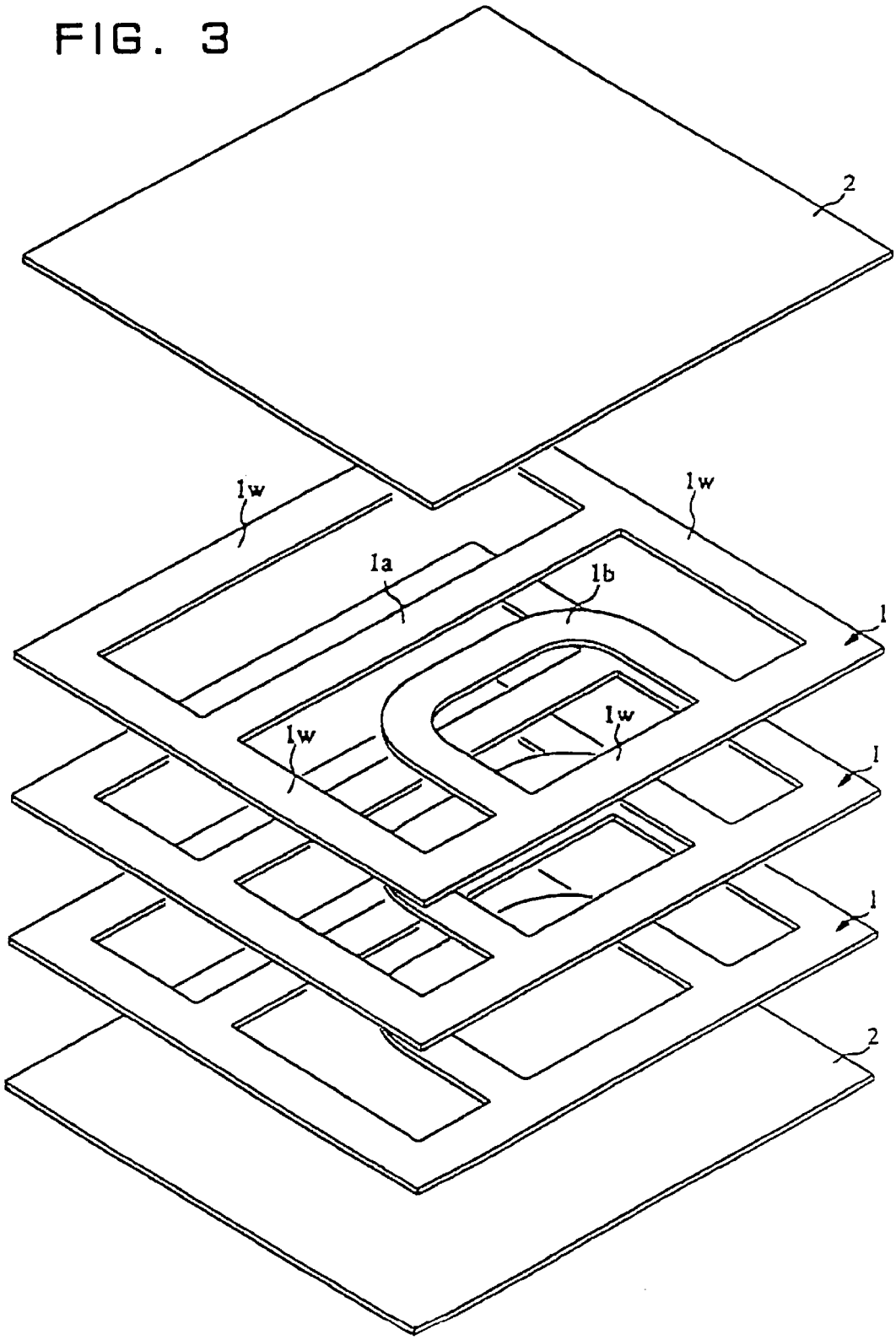
FIG. 3 is an exploded perspective view of a preliminary manufacturing stage of a dielectric waveguide according to a second embodiment.

FIG. 3 is an exploded perspective view showing the structure of a plurality of dielectric ceramic sheets in a green sheet state. In the figure, dielectric ceramic sheets 1 are provided with openings so as to define dielectric strip sections 1*a* and 1*b* which will later serve as dielectric strips, and which are connected to a frame 1*w*. The outermost dielectric ceramic sheets 2 are not provided with openings.

Figure 4:
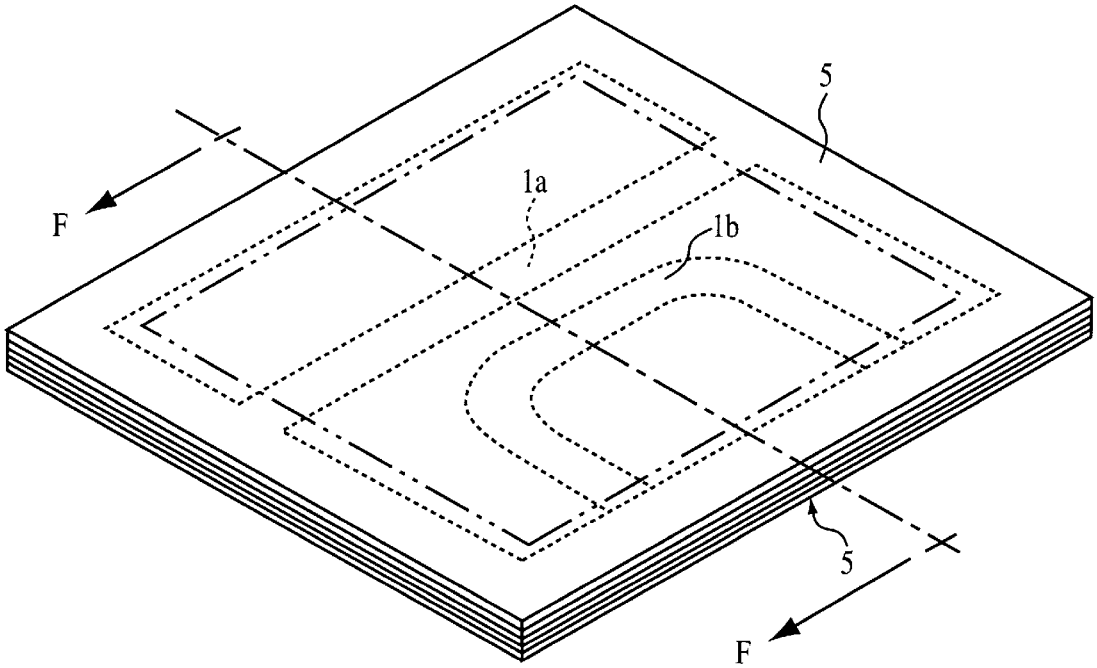
FIG. 4 is a perspective view of the manufacturing stage of FIG. 3.

FIG. 4 is a perspective view showing the condition in which the dielectric ceramic sheets 1 and 2 illustrated in FIG. 3 have been laminated in a green sheet state and baked, and then electrode films 5 have been formed on the upper and lower surfaces thereof. After the dielectric ceramic sheets are laminated and integrated as described above, the portion enclosed by a two-dot chain line is taken off (the unnecessary portion outside the two-dot chain line is removed) to obtain a dielectric waveguide having the two dielectric strips 1*a* and 1*b* between electrically conductive parallel planes.

Figure 5:
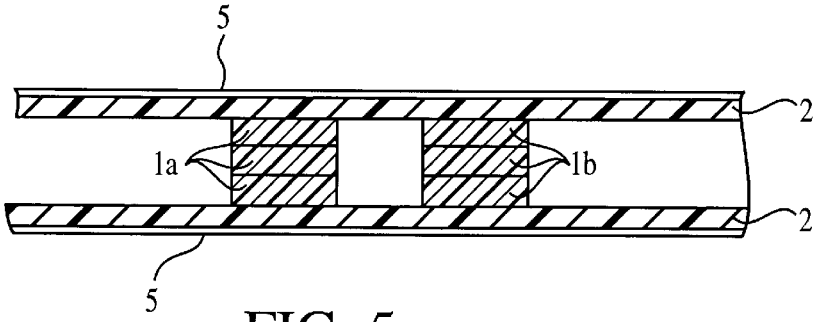
FIG. 5 is a cross-section of the manufactured dielectric waveguide of the second embodiment taken along line F—F in FIG. 4.
Figure 6:
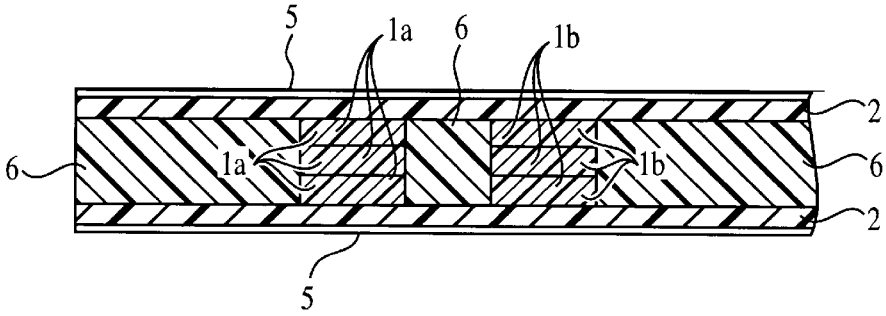
FIG. 6 is a cross-section of a modification of the dielectric waveguide of FIG. 5.

FIG. 5 is a cross-section of the dielectric waveguide taken on a line passing through the dielectric strips 1*a* and 1*b*. FIG. 6 is a cross-section showing the condition in which the air layers (the openings between the dielectric ceramic sheets 2) are filled with a dielectric 6 having a low dielectric constant. In the structure shown in either FIG. 5 or FIG. 6, by specifying the distance between the electrode films 5, and the effective dielectric constants of propagating areas and non-propagating areas, a dielectric waveguide is obtained in which the dielectric strips 1*a* and 1*b* serve as propagating areas and the other portions serve as non-propagating areas. The dielectric waveguide according to the second embodiment operates as a directional coupler having two close parallel dielectric waveguides.

The structure of a dielectric waveguide according to a third embodiment will be described below by referring to FIG. 7 and FIG. 8.

Figure 7:
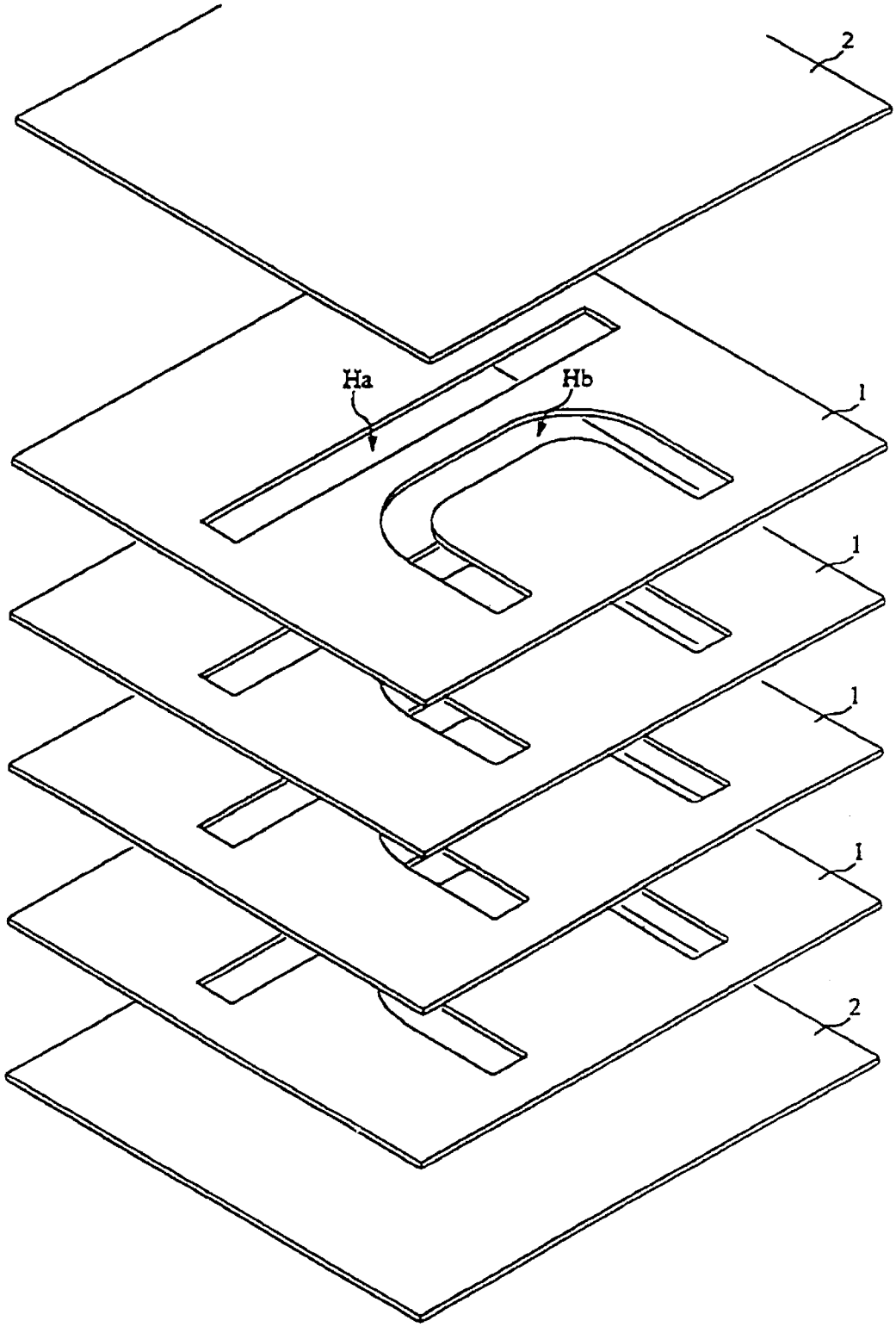
FIG. 7 is an exploded perspective view of a preliminary manufacturing stage of a dielectric waveguide according to a third embodiment.

FIG. 7 is an exploded perspective view showing the structure of a plurality of dielectric ceramic sheets in a green sheet state. In the figure, dielectric ceramic sheets 1 are provided with openings Ha and Hb. Dielectric ceramic sheets 1 and 2 are laminated and baked, electrode films are formed on both main surfaces and then an unnecessary portion is removed in the same way as shown in FIG. 4 to obtain a laminated member in which air layers are formed, for later being filled with a high-dielectric-constant dielectric.

Figure 8:
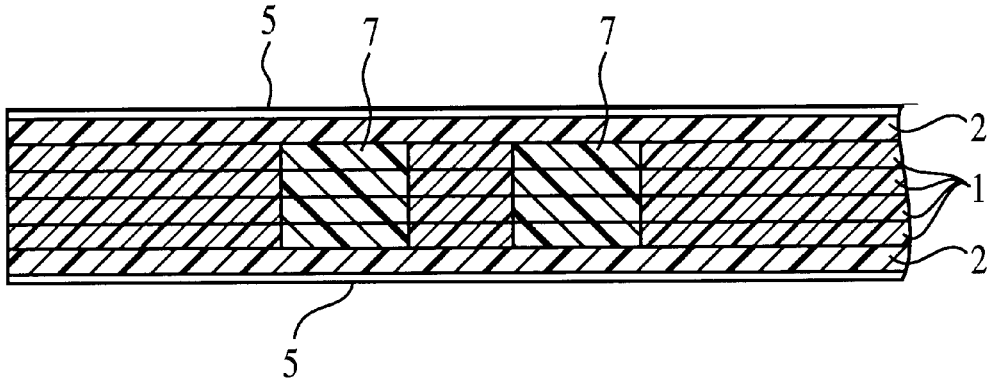
FIG. 8 is a cross-section of the dielectric waveguide of the third embodiment.

FIG. 8 is a cross-section showing the condition in which the air layers are filled with high-dielectric-constant dielectric 7. In the figure, the high-dielectric-constant dielectric 7 has a higher relative dielectric constant than the dielectric ceramic sheets 1. In this structure, by specifying the distance between the electrode films 5, and the relative dielectric constants of the high-dielectric-constant dielectric 7 and the dielectric ceramic sheets 1 and 2, a dielectric waveguide is obtained in which the high-dielectric-constant dielectric 7 serves as a propagating area and the other portions serve as non-propagating areas.

Figure 9:
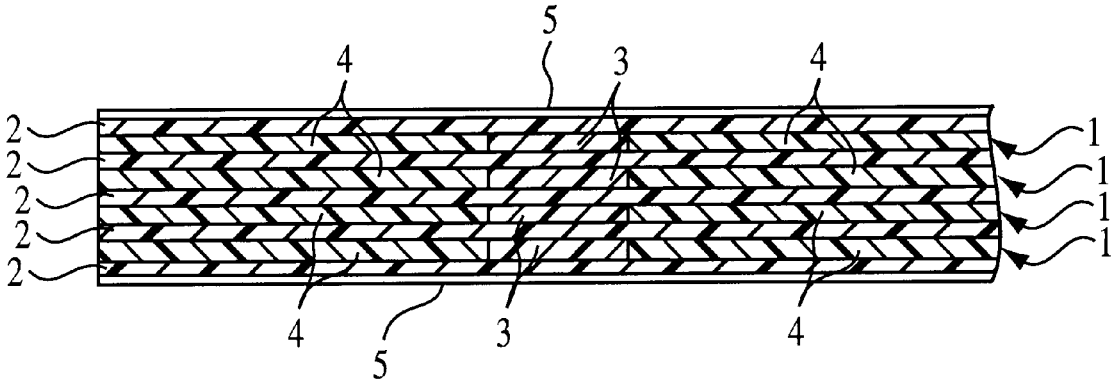
FIG. 9 is a cross-section of a dielectric waveguide according to a fourth embodiment.

FIG. 9 is a cross-section of a dielectric waveguide according to a fourth embodiment. Unlike the first embodiment shown in FIG. 1 and FIG. 2, in this embodiment, dielectric ceramic sheets 1 having high-dielectric-constant portions 3 and low-dielectric-constant portions 4, and dielectric ceramic sheets 2 having a uniform dielectric constant are alternately laminated. The dielectric ceramic sheets are laminated in this way and baked, and electrode films 5 are formed on the upper and lower surfaces. The effective dielectric constant of the integrated high-dielectric-constant portions 3 is thereby increased to provide a propagating area and the other portions serve as non-propagating areas.

The structure of a dielectric waveguide according to a fifth embodiment will be described below by referring to FIG. 10 and FIG. 11.

Figure 10:
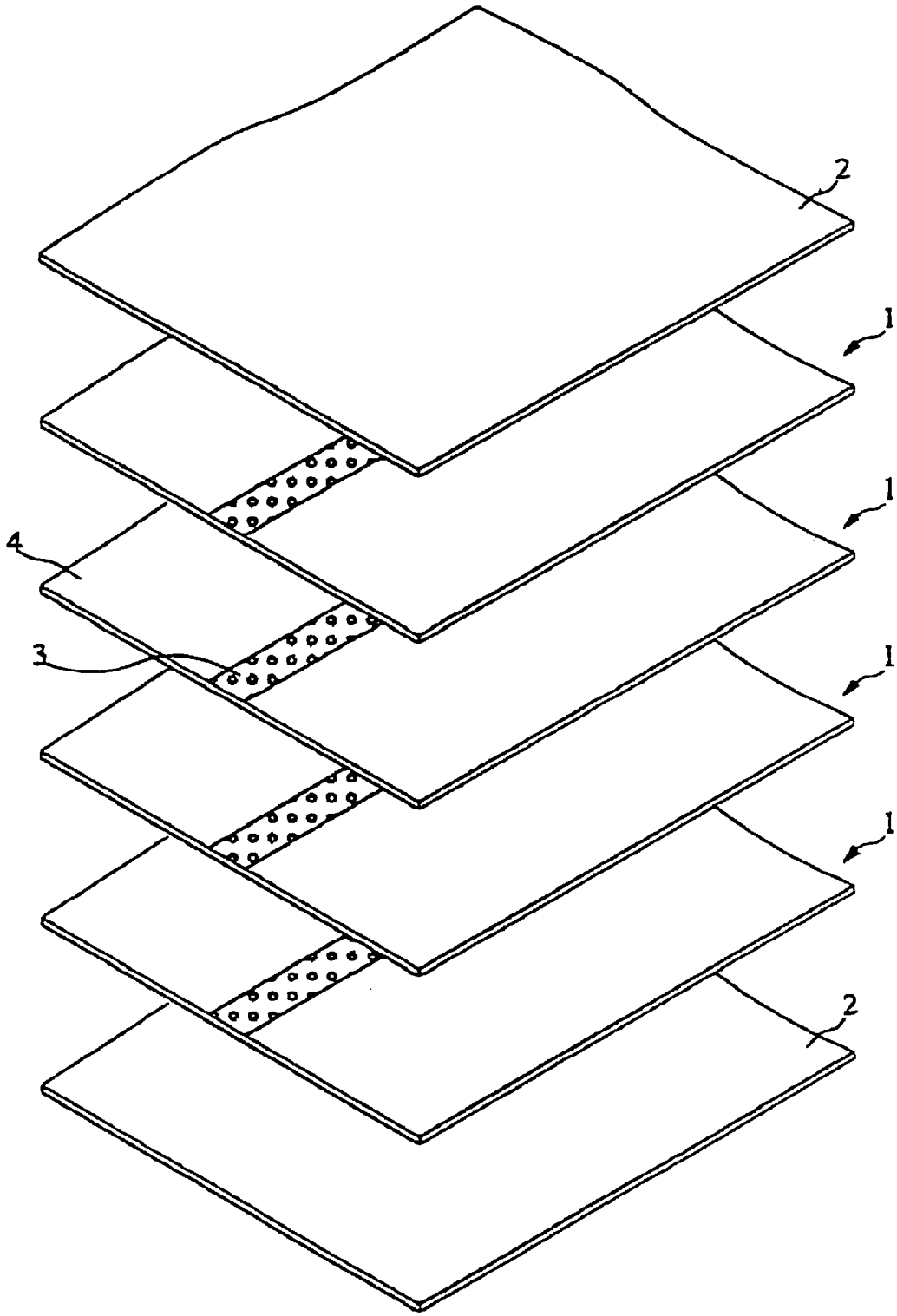
FIG. 10 is an exploded perspective view of a dielectric waveguide according to a fifth embodiment.

FIG. 10 is an exploded perspective view in which a plurality of separate dielectric ceramic sheets constituting a dielectric waveguide are shown. In the figure, there are shown dielectric ceramic sheets 1 and 2. The dielectric ceramic sheets 2 serving as the outermost layers have a uniform dielectric constant whereas the dielectric ceramic sheets 1 include high-dielectric-constant portions 3 and low-dielectric-constant portions 4. The high-dielectric-constant portions 3 are made by punching a number of minute openings (holes) in the dielectric ceramic sheets 1 and by filling the openings with high-dielectric-constant dielectric to increase their effective dielectric constant. Therefore, the effective dielectric constant of the low-dielectric-constant portions 4 is the same as that of the original dielectric ceramic sheet.

Figure 11:
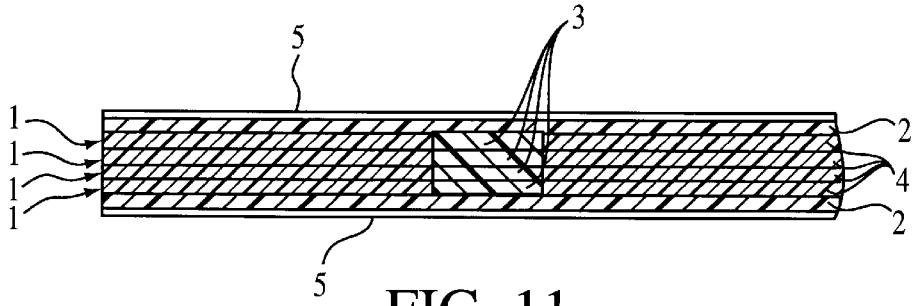
FIG. 11 is a cross-section of the dielectric waveguide of FIG. 10.

FIG. 11 shows the condition in which the dielectric ceramic sheets 1 and 2 illustrated in FIG. 10 have been laminated in a green sheet state and baked, and electrode films 5 have been formed on the upper and lower surfaces in the figure. The distance between the electrode films 5 is half the wavelength, or less, of the dielectric waveguide determined by the effective dielectric constant of the low-dielectric-constant portions 4, and is more than half the wavelength of the dielectric waveguide determined by the effective dielectric constant of the high-dielectric-constant portions 3. Under these conditions, the electrode films 5 form two electrically conductive parallel planes, the high-dielectric-constant portions 3 therebetween serve as a dielectric strip which works as a propagating area, and the low-dielectric-constant portions 4 at both sides thereof work as non-propagating areas.

Figure 12:
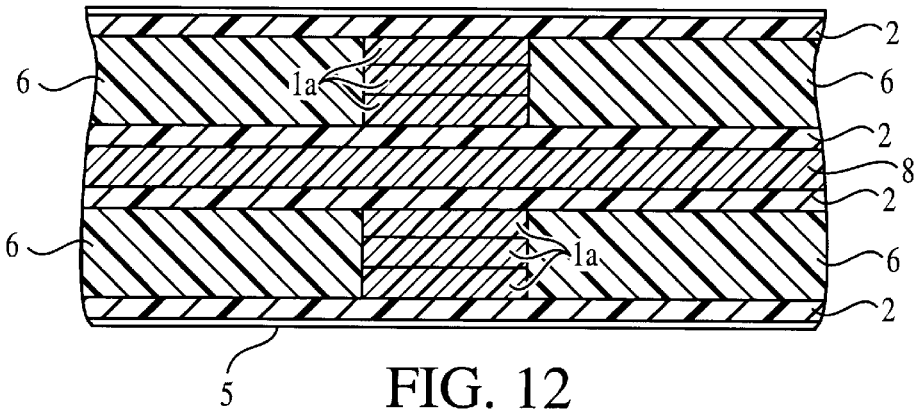
FIG. 12 is a cross-section of a dielectric waveguide according to a sixth embodiment.

FIG. 12 is a cross-section showing the structure of a double dielectric waveguide according to a sixth embodiment. This double dielectric waveguide is formed by a pair of dielectric waveguides each having a structure similar to that shown in FIGS. 3–6, but each having only one dielectric strip formed of dielectric strip sections 1*a*, and each having an electrode film 5 formed on only one surface. The respective dielectric sheets 2 of the pair of waveguides on which no electrode films 5 are formed are opposed to each other, and a substrate 8 is disposed therebetween. Thus, the substrate 8 is disposed between the respective uncoated dielectric sheets 2 corresponding to the upper and lower dielectric strips, whereby a double dielectric waveguide is formed in which dielectric strip portions 1*a* serve as a propagating area and the other portions serve as a non-propagating area. The substrate 8 may have a suspended line, a slot line or a coplanar line on its surface. The suspended line, for example, may be formed by providing an electrically conductive pattern ("strip") on the substrate 8. Thereby, the dielectric waveguide may be coupled with a circuit element formed on the substrate.

The structure of a dielectric waveguide according to a seventh embodiment will be described below by referring to FIGS. 13, 14A and 14B.

Figure 13:
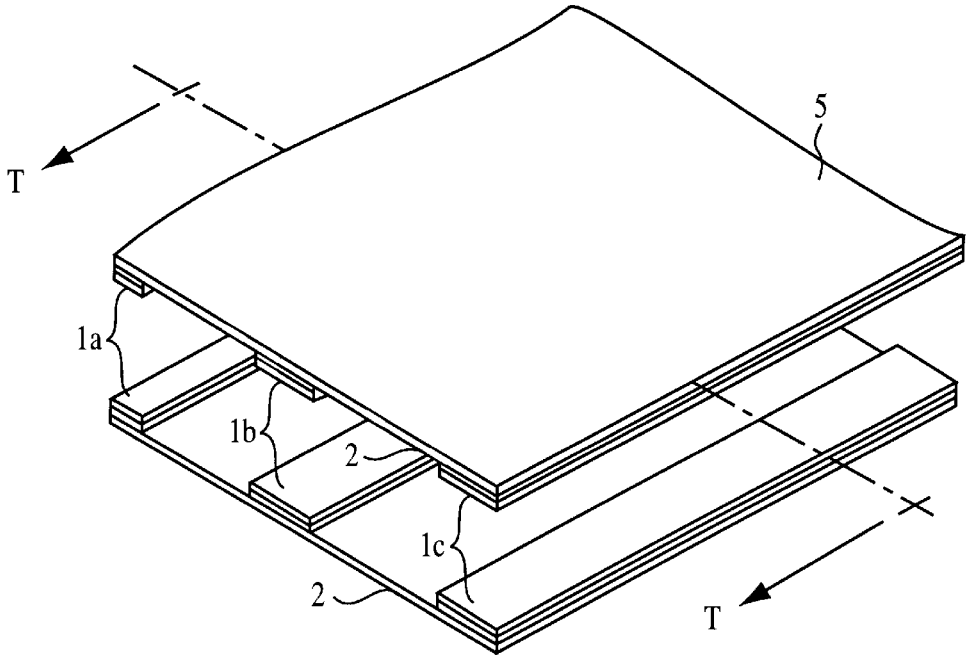
FIG. 13 is an exploded perspective view of a dielectric waveguide according to a seventh embodiment.
Figure 14A:
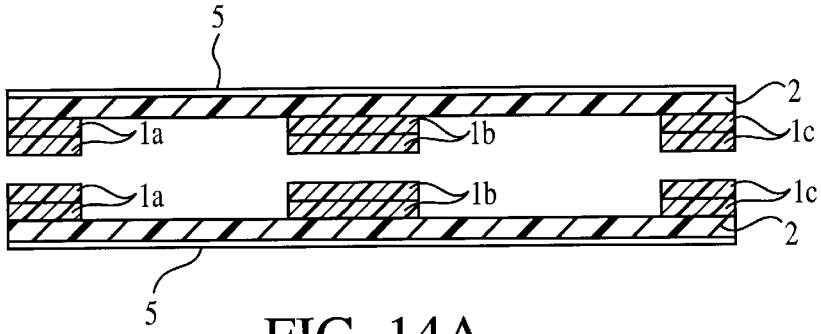
FIG. 14A is a cross-section of the dielectric waveguide of FIG. 13 taken along line T—T in FIG. 13.
Figure 14B:
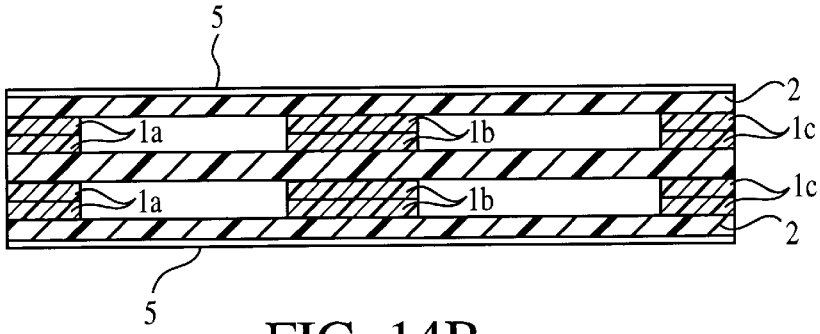
FIG. 14B is a modification thereof.
Figure 15A:
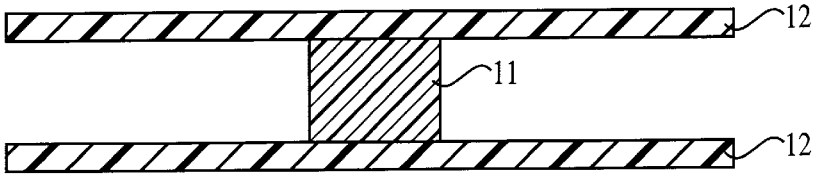
FIG. 15A PRIOR ART
FIGS. 15A and 15B are cross-sections respectively showing two examples of conventional dielectric waveguides.
Figure 15B:
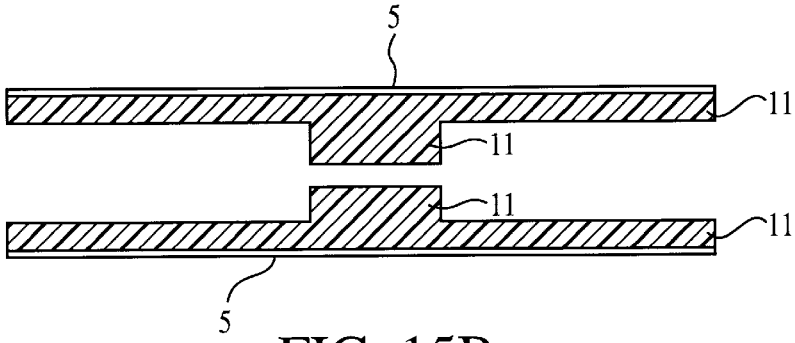
FIG. 15B PRIOR ART

FIG. 13 is a partially exploded perspective view of a main section of a dielectric waveguide. In the figure, there are shown dielectric strip sections 1*a*, 1*b*, 1*c*, and dielectric ceramic sheets 2. The dielectric strip sections 1*a*, 1*b*, and 1*c* are formed by providing dielectric ceramic sheets with openings as shown, for example, in FIG. 3, to form respective layers of dielectric strip sections. The layers are laminated and baked to make a pair of laminated members, and electrode films 5 are formed on their outer surfaces. FIG. 14A is a cross-section of the dielectric waveguide shown in FIG. 13, and FIG. 14B is a cross-section of a similar dielectric waveguide in which a substrate 8 is sandwiched by the two laminated members. In either structure, the laminated portions comprising the dielectric strip sections 1*a*, 1*b*, and 1*c* operate as dielectric strips and serve as propagating areas, and the other portions serve as non-propagating areas. In the structure shown in FIG. 14B, the substrate 8 may be provided with an electrically conductive pattern and circuit devices such as a VCO and a mixer. Thus, a plane-circuit coupling type dielectric waveguide apparatus may be formed in which these components are coupled with the dielectric waveguide.

In each embodiment, the outermost layers are formed of dielectric ceramic sheets and electrode films are provided on the outermost layers to form electrically conductive parallel planes. Alternatively, the outermost layers may be formed of metal plates to provide the electrically conductive planes.

In each embodiment, homogeneous dielectric ceramic sheets are used for the outermost-layer dielectric ceramic sheets. Instead of such homogeneous dielectric ceramic sheets, ceramic sheets having high-effective-dielectric-constant portions and low-effective-dielectric-constant portions may be used for the outermost layers, as well as the inner layers.

In addition to a non-radiative dielectric waveguide, it is needless to say that the present invention can be also applied to an H guide in which the distance between two electrically conductive parallel planes exceeds half the wavelength.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dielectric waveguide comprising a dielectric strip disposed between two substantially parallel electrically conductive planes, said dielectric waveguide comprising at least three substantially planar laminated dielectric ceramic sheets comprised in a laminated body, said laminated body having a first area having a high effective dielectric constant and a second area having a lower effective dielectric constant than that of the first area, and electrode films disposed on opposite outer surfaces of said laminated body, whereby the first area serves as the dielectric strip and the electrode films serve as the electrically conductive planes; and wherein each said dielectric ceramic sheet has a respective first portion of relatively high dielectric constant, said first portions together comprising said first area of said laminated body, and a respective second portion of each said ceramic sheet having a dielectric constant relatively lower than that of said corresponding first portion, said second portions together comprising a said second area adjacent to said first area serving as the dielectric strip.

2. A dielectric waveguide according to claim 1, wherein said first portions are defined by respective openings in said corresponding dielectric ceramic sheets, said respective openings being laminated together to comprise said first area in said laminated body, said first area being filled with a dielectric having a higher dielectric constant than a dielectric constant of said second portions of said dielectric ceramic sheets.

3. A dielectric waveguide according to claim 1, wherein said second area is a non-propagating area which blocks an electromagnetic wave which is transmitted by said dielectric strip.

4. A dielectric waveguide according to claim 1, wherein said second portions are defined by respective openings in said corresponding dielectric ceramic sheets, said respective openings being laminated together to comprise said second area in said laminated body.

5. A dielectric waveguide according to claim 4, further comprising a respective dielectric filled in said second area, said respective dielectric having a lower dielectric constant than a dielectric constant of said first portions of said dielectric ceramic sheets.

6. A dielectric waveguide comprising a pair of dielectric strips disposed between two substantially parallel electrically conductive planes, said dielectric waveguide comprising two dielectric plates, each dielectric plate comprising at least three substantially planar laminated dielectric ceramic sheets comprised in a laminated body, said laminated body having a first area having a high effective dielectric constant and a second area having a lower effective dielectric constant than that of the first area, each dielectric plate having a respective electrode film disposed on one main surface thereof, and the respective surfaces on which the corresponding electrode films are disposed on outside surfaces of said dielectric waveguide, and the first areas being opposed to each other and disposed between said electrode films, whereby said first areas serve as the dielectric strips and the electrode films serve as the electrically conductive planes.

7. A dielectric waveguide according to claim 6, further comprising a dielectric substrate disposed between said respective dielectric strips of said pair of dielectric plates.

8. A dielectric waveguide according to claim 6, wherein in each said dielectric plate, each said dielectric ceramic sheet has a respective first portion of relatively high dielectric constant, said first portions of said plurality of ceramic sheets together comprising said first area of said laminated body, and a respective second portion having a dielectric constant relatively lower than that of said first portion, said second portions together comprising a second area adjacent to said first area serving as the pair of dielectric strips.

9. A dielectric waveguide according to claim 8, wherein said respective second area is a non-propagating area which blocks an electromagnetic wave which is transmitted by said parts of dielectric strips.

10. A dielectric waveguide according to claim 6, wherein said respective second portions are defined by respective openings in said plurality of dielectric ceramic sheets, said openings being laminated together to comprise said second area in said laminated body.

11. A dielectric waveguide according to claim 10, further comprising a dielectric filled in said second area, said dielectric having a lower dielectric constant than a dielectric constant of said first portions of said dielectric ceramic sheets.

12. A dielectric waveguide according to claim 6, wherein said first portions are defined by respective openings in said dielectric ceramic sheets, said openings being laminated together to comprise said first area in said laminated body, said first area being filled with a dielectric having a higher dielectric constant than a dielectric constant of said second portions of said dielectric ceramic sheets.

13. A method of producing a dielectric waveguide comprising the steps of:

preparing at least three substantially planar ceramic green sheets, each planar sheet having:

a respective first portion; and a respective second portion whose dielectric constant is lower than the dielectric constant of the first portion;

laminating said plurality of ceramic green sheets while aligning said respective first portions with respect to each other to form a laminated body;

firing said laminated body; and disposing conductive layers on upper and lower surfaces of said laminated body;

wherein said dielectric constant of said second portion is reduced by forming openings in said second portion.

14. A method according to claim 13, further comprising the step of filling said openings with a dielectric having a lower dielectric constant than said first portion.

* * * * *